US009283614B2

(12) United States Patent
Lazorkin

(10) Patent No.: US 9,283,614 B2
(45) Date of Patent: Mar. 15, 2016

(54) FOUR-DIE FORGING DEVICE FOR FORGING PRESSES

(76) Inventor: Viktor Andriiovych Lazorkin, Zaporizhya (UA)

( * ) Notice: Subject to any disclaimer, the term of this patent is extended or adjusted under 35 U.S.C. 154(b) by 316 days.

(21) Appl. No.: 13/992,955

(22) PCT Filed: Jan. 31, 2011

(86) PCT No.: PCT/UA2011/000007
§ 371 (c)(1),
(2), (4) Date: Jun. 10, 2013

(87) PCT Pub. No.: WO2012/082085
PCT Pub. Date: Jun. 21, 2012

(65) Prior Publication Data

US 2013/0247642 A1 Sep. 26, 2013

(30) Foreign Application Priority Data

Dec. 16, 2010 (RU) ..... 2010 15141

(51) Int. Cl.
*B21J 13/02* (2006.01)
*B21J 9/02* (2006.01)
*B21J 7/14* (2006.01)

(52) U.S. Cl.
CPC .. *B21J 13/02* (2013.01); *B21J 7/14* (2013.01); *B21J 9/02* (2013.01)

(58) Field of Classification Search
CPC ..... B21J 7/02; B21J 7/14; B21J 7/18; B21J 9/02; B21J 9/027; B21J 13/02; B21J 13/025; B21J 13/06
See application file for complete search history.

(56) References Cited

U.S. PATENT DOCUMENTS

| | | | |
|---|---|---|---|
| 3,650,143 | A | 3/1972 | Ruget |
| 3,670,556 | A | 6/1972 | Kralowetz |

(Continued)

FOREIGN PATENT DOCUMENTS

| | | | |
|---|---|---|---|
| DE | 1936012 | C2 | 6/1984 |
| EP | 2014390 | A1 | 1/2009 |
| JP | 56033145 | A | 4/1981 |
| RU | 2242322 | C1 | 12/2004 |
| RU | 2257278 | C1 | 7/2005 |
| RU | 2282517 | C2 | 8/2006 |

(Continued)

OTHER PUBLICATIONS

Supplementary European Search Report for Application No. 11848810.5 dated Feb. 24, 2015.

*Primary Examiner* — Debra Sullivan
(74) *Attorney, Agent, or Firm* — Bachman & LaPointe, P.C.

(57) ABSTRACT

Four-die forging device for forging presses can be employed to forge ingots and billets in a variety of steels and alloys on forging presses and is intended to provide for a longer repair-free service life of the device, a higher reliability, an increased forging process output and a better quality of forged parts. The holders (3, 4) of the side dies (5, 7) have a shape approximating to that of a truncated pyramid with the center of mass (47) of the "side die holder-side die" system located within the longitudinal section of the side die holder. The apart-guiding ways (9-12) are arranged either on the side surfaces of the die holders (1, 2), or on the inclined planes (22-29) of the holders (1-4) of the dies (5-8) in the longitudinal symmetry plane of the device, or on both of them. Internal planes of the apart-guiding ways are formed to enclose the planes of adjacent die holders thus creating a clutch-type connection. Provided in the bottom part of each side die holder are ledges (48, 49) where against the antifriction plates (30-37) thrust. Working surface of each die at its cross-sectional area consists of a central working zone (52) and two side zones (53, 54). Maximum width of the die working surface (bmax) and the antifriction plate sliding surface length (1) are in a ratio of bmax/l≤1.5. The device is characterized by a longer repair-free service life, higher reliability, increased forging process output and better quality of forged parts.

16 Claims, 23 Drawing Sheets

(56) References Cited

U.S. PATENT DOCUMENTS

| | | | | |
|---|---|---|---|---|
| 4,941,342 | A * | 7/1990 | Herndl et al. | 72/402 |
| 6,244,087 | B1 * | 6/2001 | Blaimschein et al. | 72/76 |
| 6,401,516 | B1 * | 6/2002 | Herndl et al. | 72/453.18 |
| 2006/0185417 | A1 | 8/2006 | Rozhdestvenskiy et al. | |

FOREIGN PATENT DOCUMENTS

| | | | |
|---|---|---|---|
| RU | 2314175 | C2 | 1/2008 |
| UA | 29183 | A | 10/2000 |
| UA | 34978 | A | 3/2001 |
| UA | 67879 | C | 7/2004 |

* cited by examiner

*View C*

*Version I*

*View C*

*Version II*

View C

Version III

D-D

Version I

A-A

Version I

A-A

Version II

A-A

Version III

A-A

Version IV

A-A

Version V

A-A

Version VI

A-A

Version VII

E-E

N-N

FOUR-DIE FORGING DEVICE FOR FORGING PRESSES

BACKGROUND OF THE INVENTION

The present invention relates to the field of metal forming in general and is concerned more specifically with four-die forging devices; it can be used to forge ingots and blanks of a variety of steels and alloys on forging presses, including hydraulic forging presses. The invention can be employed in machine-building and metallurgical industries for the production of long-sized components like rods, columns, intermediate shafts, torsion bars, mill rollers and also in the production of forged blanks from ingots and rolled stock of carbon steels, medium-alloyed steels, tool steels, high-alloyed steels and alloys and also non-ferrous metals and alloys.

Known in the prior art is a four-die forging device having dies with a working surface of each die generated by a number of planes, top- and bottom dies holders comprising inclined sliding planes and side dies holders formed to have inclined sliding planes corresponding to said sliding planes of top- and bottom die holders and arranged so that they are movable relative to said top- and bottom die holders while being interconnected thereto by means of eight guiding ways of П-shaped cross-section fixed on the holders, internal planes of which guiding ways are formed to enclose the planes of die holders thus creating a clutch-type connection (RU 2282517 C2, МПк(2006.01) B21J 1/04, 13/00, 7/16, 27.08.2006).

The present device provides for high output of the forging process and high metal quality of forged parts. However, such design does not ensure high reliability and long service life of the device.

The most similar to the claimed four-die forging device is the embodiment according to the Russian Federation patent (RU 2314175 C2, МПк(2006.01) B21J 13/02, 10.01.2008) comprising top- and bottom die holders having inclined planes, two side die holders having inclined planes which correspond to respective inclined planes of the top- and bottom die holders and being operationally interconnected thereto by means of side apart-guiding ways of F-shaped cross-section, centering guideways installed on the inclined planes of the top- and bottom die holders or on the inclined planes of side die holders in one plane or in a plurality of planes which are perpendicular to the longitudinal axis of the device and arranged in the centering grooves formed by groove walls made on the inclined planes respectively of side die holders or top- and bottom die holders and by side planes of antifriction plates arranged on the inclined planes of die holders.

The described embodiment provides for a sufficiently long service life of the device with no need for reconditioning arising from score building on the working surfaces of the antifriction plates. However, the known forging device yields neither high production efficiency nor sufficiently high reliability because of some of its components being damage-prone and vulnerable to increased wearing-out.

It is an object of the present invention to develop a four-die forging device for forging presses wherein by means of design improvements the risk of damage to some components is significantly reduced due to better reliability of components fastening, smooth motion without any jamming, misalignment and score building and reduced wearing-out which would result in longer repair-free service life of the device, better reliability in operation, higher forging output and better quality of forged products.

SUMMARY OF THE INVENTION

To achieve the object, proposed herewith is a four-die forging device for forging presses comprising top- and bottom die holders having inclined planes, operationally interconnected thereto side die holders having inclined planes which correspond to respective inclined planes of the top- and bottom die holders and being arranged so that they are movable relative to the top- and bottom die holders while being interconnected thereto by means of apart-guiding ways, antifriction plates arranged on the inclined planes of the die holders and four dies with working surfaces, wherein the side die holders have a longitudinal section shape approximating to that of a truncated pyramid with the centre of mass of the "side die holder-side die" system located within the limits of a side die holder longitudinal section, the apart-guiding ways are arranged either on the side surfaces of the die holders in amount of at least four apart-guiding ways, or on the inclined planes of the die holders in the longitudinal symmetry plane of the device in amount of at least two apart-guiding ways, or on the side surfaces and on the inclined planes of the die holders in the longitudinal symmetry plane of the device in amount of at least six apart-guiding ways, internal planes of said apart-guiding ways being formed to enclose the planes of adjacent die holders or elements rigidly secured on said die holders thus creating a clutch-type connection, while in the bottom part of inclined plane of each side die holder respective ledges are provided, whereagainst the antifriction plates thrust, a working surface of each die at its cross-section consists of a central working zone and two side zones with the maximum width of die working surface ($b_{max}$) and the antifriction plate sliding surface length (l) being in a ratio of $b_{max}/l \leq 1.5$. Further contributory for achievement of said technical result are the following provisions aimed to create some specific design features depending upon particular customer's products to be produced in the device and to facilitate its manufacture, assembly and servicing:

- width of die central working zone ($b_c$) and die length (L) are in a ratio of $b_c/L=0.2\text{-}1.1$;
- the bottom die holder can be of a T-shaped cross-section with a wide portion located at its bearing surface side;
- the top- and bottom die holders can be of a T-shaped cross-section with a wide portion located at their bearing surfaces sides;
- eight apart-guiding ways can be mounted on the die holders side surfaces;
- centering guideways can be mounted on the inclined planes of the top- and bottom die holders in the device longitudinal symmetry plane, and antifriction plates of П-shaped cross-section can be mounted in twos on each inclined plane of the side die holders, said antifriction plates forming each with one of its sides a groove of rectangular cross-section between them, which groove serves to receive the centering guideways, while the other sides of said antifriction plates enclose side planes of the side die holders;
- four apart-guiding ways formed as H-beams can be installed in T-shaped grooves on the inclined planes of the die holders in the device longitudinal symmetry plane;
- antifriction coating can be provided on the internal planes of the apart-guiding ways which serve to ensure a movable contact in the clutch-type connection;
- the device can be also provided with at least two centering guiding columns mounted in the bottom die holder symmetrically relative to its vertical and longitudinal symmetry planes, while the top die holder is made spring-loaded relative to the bottom die holder so that said top die holder is movable in the guiding columns under spring action relative to the bottom die holder;

the apart-guiding way pairs arranged on the die holders side surfaces symmetrically relative to the device longitudinal symmetry plane can be secured in twos on the side surfaces of the top- and bottom die holders with the help of pins, studs or bolts penetrating through said die holders parallel to the device vertical symmetry plane;

apart-guiding ways can be secured on the die holders side surfaces with the help of pins, studs or bolts arranged in a plane perpendicular to the device vertical symmetry plane;

the dies can be secured to respective holders with the help of pins, studs or bolts penetrating through said die holders parallel to the device vertical symmetry plane and with the help of clamps;

the device can be also equipped with a system designed to supply lubricant to friction surfaces with the central ducts, which serve to supply lubricant to the device, running through the side die holders parallel to the antifriction plates sliding planes;

the device can be also equipped with a die cooling system comprising hoses and ducts arranged within the die holders and dies, with each die body including at least one duct located under said die working zone parallel to its surface;

the antifriction plates mounted on the top- and bottom die holders can be otherwise made of bronze, and antifriction plates secured to the side die holders can be made of steel;

the antifriction plates can be otherwise made of composite material containing high-temperature polyamide and long-fiber carbon with addition of graphite filler normally used in self-lubricating slider bearing production.

BRIEF DESCRIPTION OF THE DRAWINGS

The subject-matter of the claimed four-die forging device for forging presses is explained below with reference to attached drawings FIGS. 1-35.

Q-Q—longitudinal symmetry plane of the device.

U-U—vertical symmetry plane of the device.

DETAILED DESCRIPTION

Figure 1:
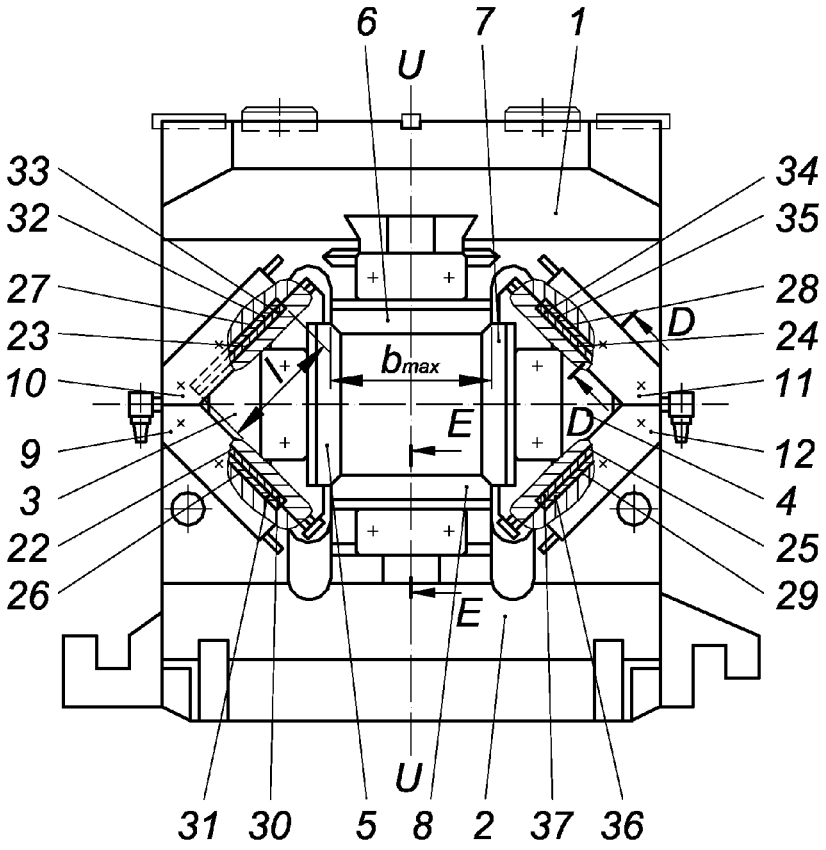
FIG. 1 shows a static general view of the four-die forging device, a front view (with the dies closed)
Figure 2:
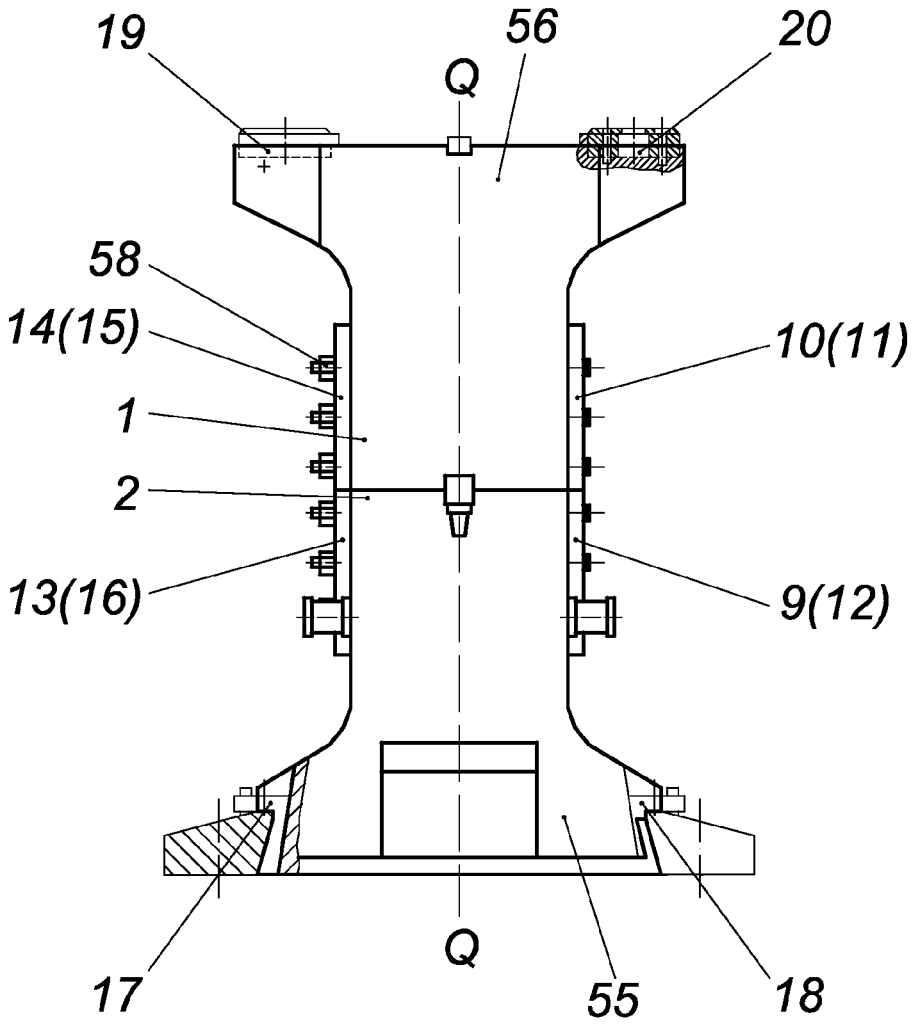
FIG. 2 shows a general side view of the four-die forging device.
Figure 31:
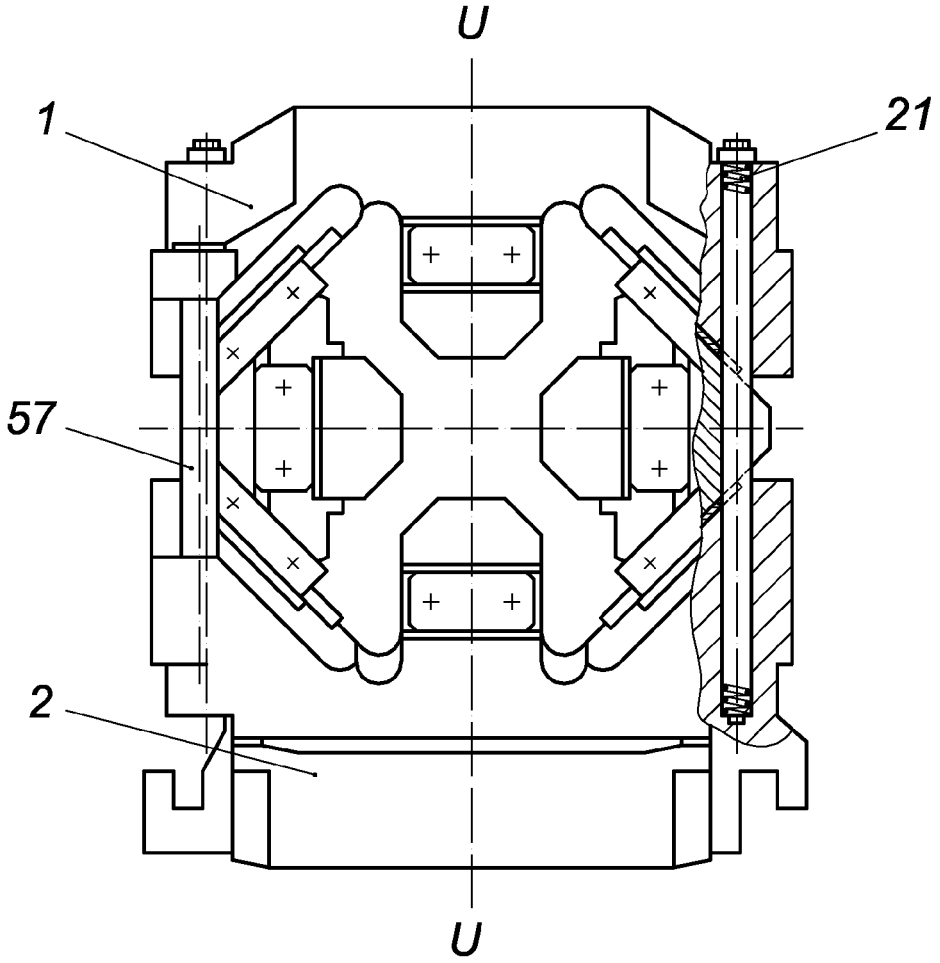
FIG. 31 shows the four-die forging device complete with centering guide columns and springs.

The four-die forging device for forging device comprises the holder 1 of the top die, the holder 2 of the bottom die, the holders 3, 4 of the side dies, the dies 5-8, the apart-guiding ways 9-18 (FIGS. 1, 2). The holder 2 of the bottom die comprises adequate fastening points intended to rigidly fasten said holder to the bottom plate of the press (not shown) with the help of grooves 17, 18, for example, of a dovetail type or with the help of suitable clamps. The holder 1 of the top die can also comprise fastening points 19, 20 for the purpose of rigid fastening to the top plate which is mounted on the press movable cross-beam. Both die holders 1, 2 are rigidly secured to the press in case the movable cross-beam (not shown) is employed in the press to move the top die holder 1 upward. Otherwise, in case of springs 21 being employed in the press to move the top die holder 1 upward, no fastening of the top die holder 1 to the press movable cross-beam is employed (FIG. 31).

Figure 4:
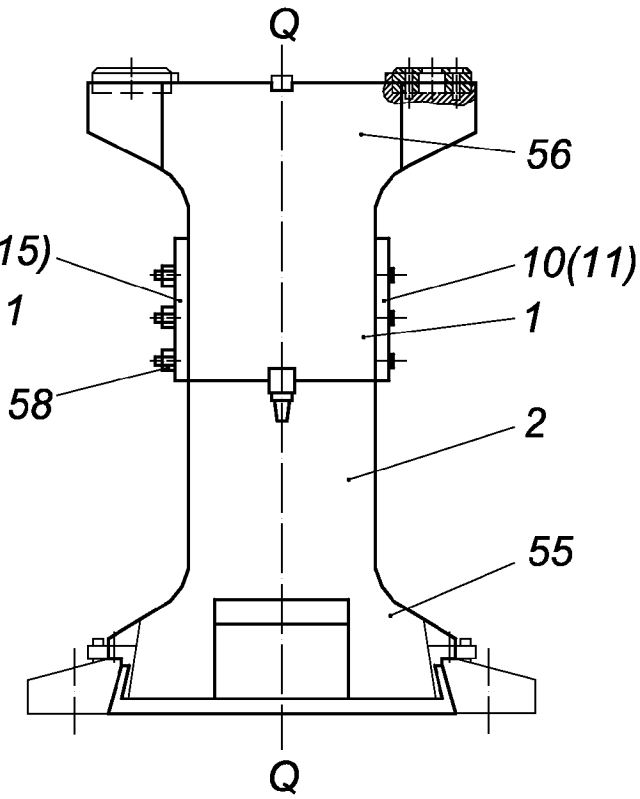
FIG. 4 shows a general side view of the four-die forging device with four top apart-guiding ways.
Figure 3:
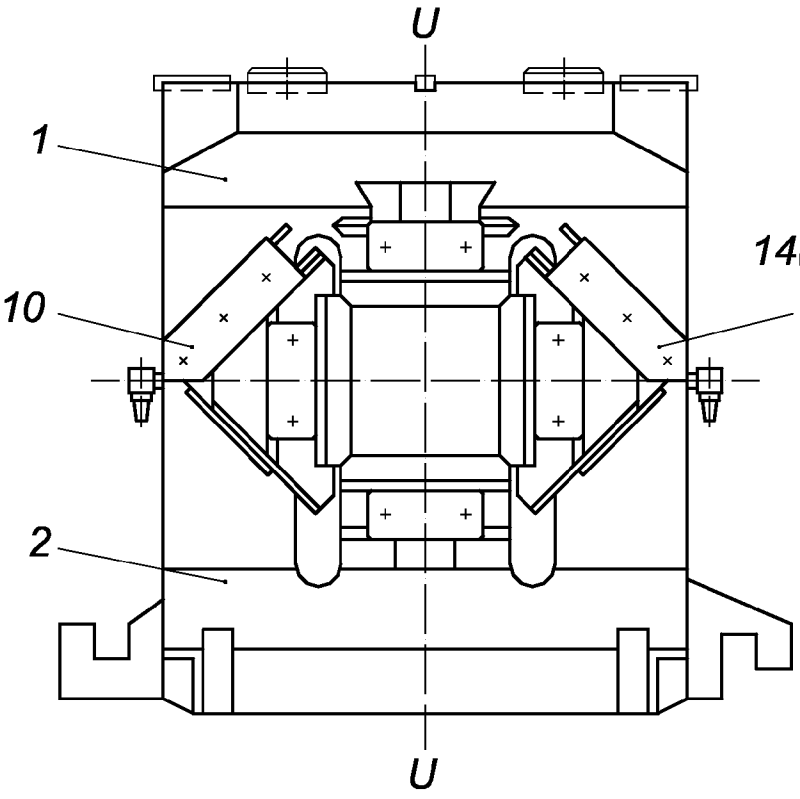
FIG. 3 shows a general front view of the four-die forging device with four apart-guiding ways secured on the side surfaces of the top die holder.
Figure 5:
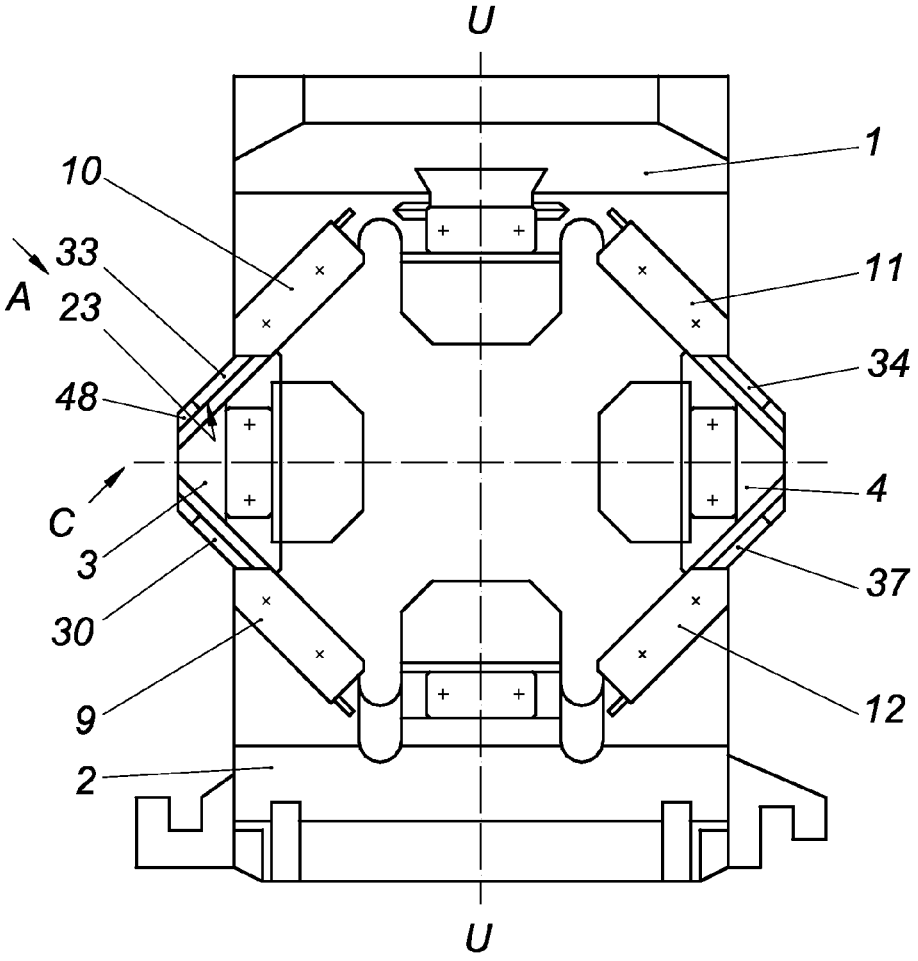
FIG. 5 shows the four-die forging device in its open state.

The holders 3, 4 of side dies 5, 7 comprise inclined planes 22-25 corresponding to respective inclined planes 26-29 of the holders 1, 2 of the top die 6 and the bottom die 8 and are operationally connected thereto by means of the apart-guiding ways 9-16 or 42-45 serving to bring side die holders 3, 4 into reciprocating motion (FIG. 1-11, 15-21). Mounted on the inclined planes 22-29 of the die holders 1-4 are the antifriction plates 30-37 serving to reduce friction between the die holders when they move relative to each other. There exist several versions of the apart-guiding ways installation scenario and the number of guiding ways used in the device can also vary. Presented in FIGS. 1, 2 is a version of eight apart-guiding ways 9-16 installed on the side surfaces of the holders 1, 2 of the top- and bottom dies. Such scenario of the apart-guiding ways arranged on the side surfaces of the die holders 1, 2 allows to achieve the most smooth motion of the latter without any jamming and/or misalignment effects. The device function can be also ensured with the help of four apart-guiding ways 10, 11, 14, 15 installed on the side surfaces of the top die holder 1 (FIGS. 3, 4). In this case with the top die holder 1 being moved upward, the side die holders 3, 4 move down by gravity in four apart-guiding ways 10, 11, 14, 15.

There exist a number of versions of the apart-guiding ways fastening to the die holders' side surfaces.

The first known version of the apart-guiding ways 9-16 fastening consists in that the guiding ways are fixed-mounted on the top die holder 1 and the bottom die holder 2, while the internal plane of said apart-guiding way is movably contacting the respective enclosed plane formed on the holder 3 or holder 4 of the side dies, or the plane of a part rigidly secured to the side die holder, for example, the plane of the antifriction plate 33, 41 (FIGS. 1, 6-8). However, such apart-guiding ways fixing scenario does not provide in all the cases for desirably high standard of the device assembly and for its maximum long between-repairs service life. Also possible is another version of the apart-guiding ways fastening consisting in that the apart-guiding way is fixed on the side die holder, while the internal plane of said guiding way is movably contacting the enclosed plane formed on the top- or bottom die holder, or the plane of a part rigidly fixed to the top- and bottom die holder, for example, the plane of antifriction plate (not shown).

Figure 6:
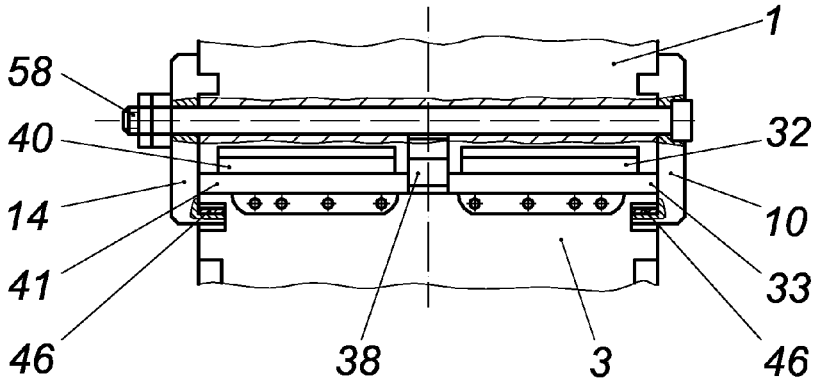
FIG. 6 shows view C (version I) as per FIG. 5.
Figure 7:
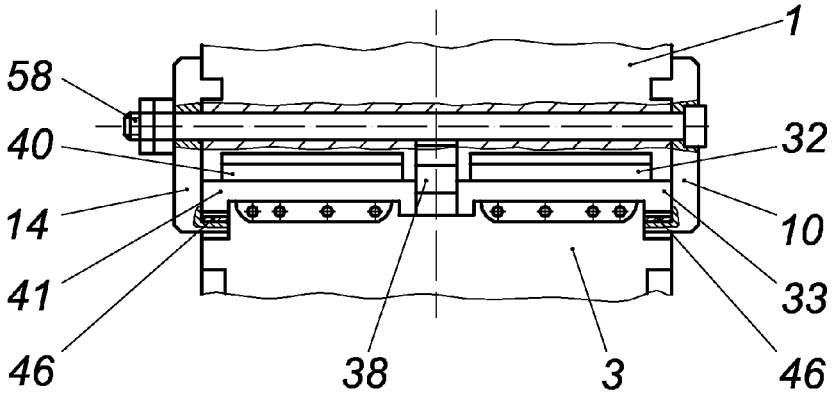
FIG. 7 shows view C (II version) as per FIG. 5.
Figure 8:
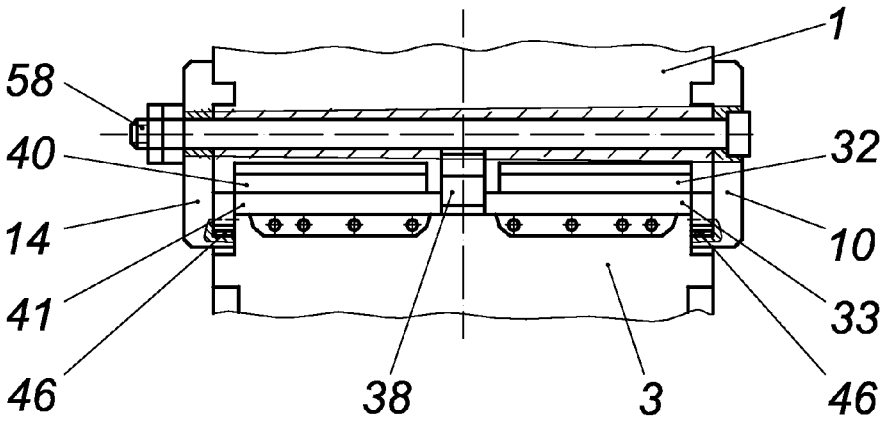
FIG. 8 shows view C (version III) as per FIG. 5.

Mounted on the inclined planes of the holders 1, 2 may be centering guideways 38, 39 which enter the grooves of rectangular cross-section provided in the holders 3, 4 (FIGS. 6-8, 12). Said centering guideways 38, 39 contribute to reduce lateral displacement of the holders 1-4 and thus to provide for a higher forging accuracy. Grooves of rectangular cross-section arranged in the device transverse symmetry plane and serving to receive the centering guideways may be formed by antifriction plates 33, 41 of either rectangular cross-section or Π-shaped cross-section (FIGS. 6-8). Said antifriction plates 33, 41 of Π-shaped cross-section contacting antifriction plates 32, 40 may form each of them with one of its sides a groove of rectangular cross-section which serves to receive centering guideways 38, 39 while with their other sides they may enclose the side planes of the holders 3, 4. Then the internal planes of the apart-guiding ways 9-16 enclose antifriction plates 33, 34 thus building a movable contact therewith when the holder 1 is moved upward. Such design facilitates the manufacture and assembly of the device.

Figure 9:
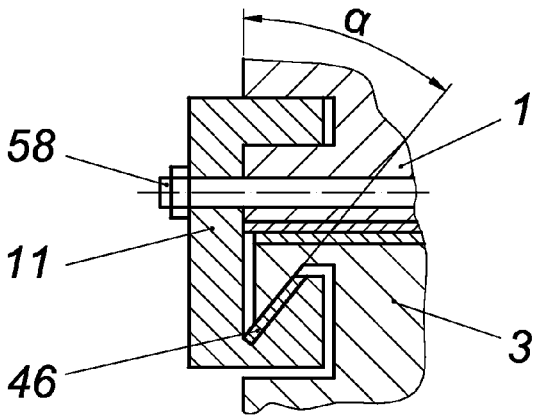
FIG. 9 shows section D-D (version I) as per FIG. 1.
Figure 10:
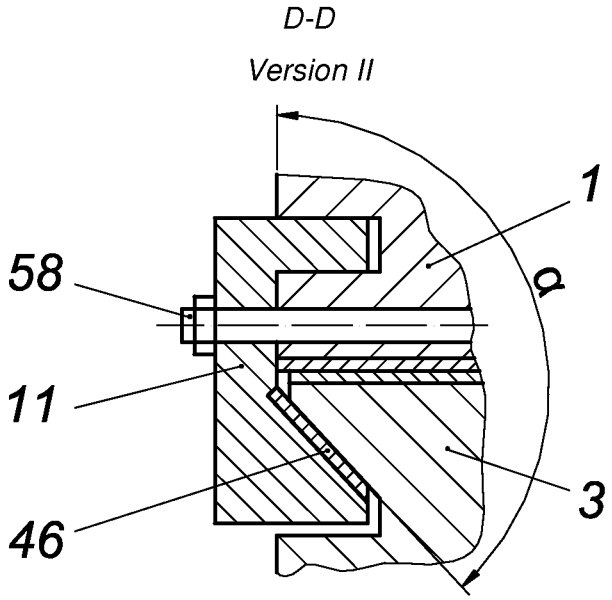
FIG. 10 shows section D-D (version II) as per FIG. 1.
Figure 11:
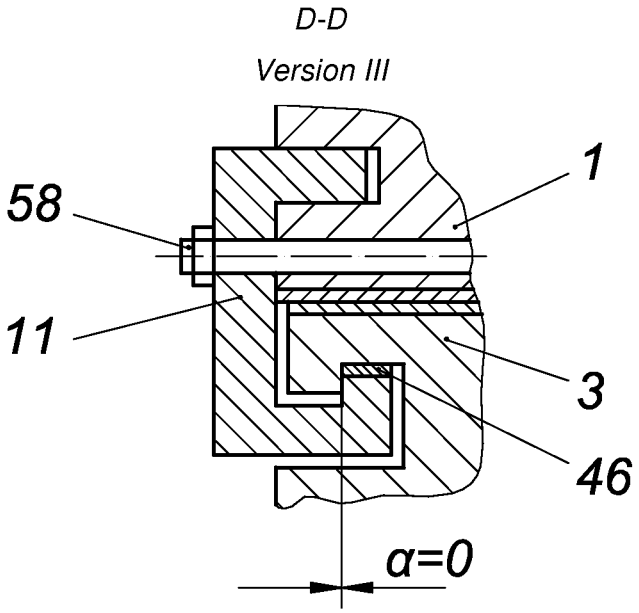
FIG. 11 shows section D-D (version III) as per FIG. 1.
Figure 12:
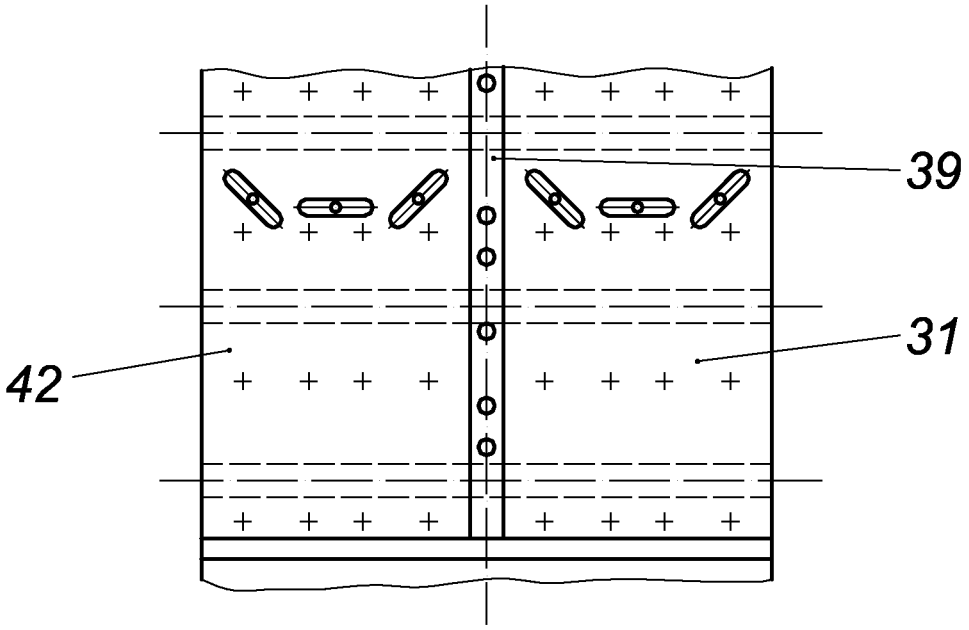
FIG. 12 shows view T as per FIG. 5.
Figure 13:
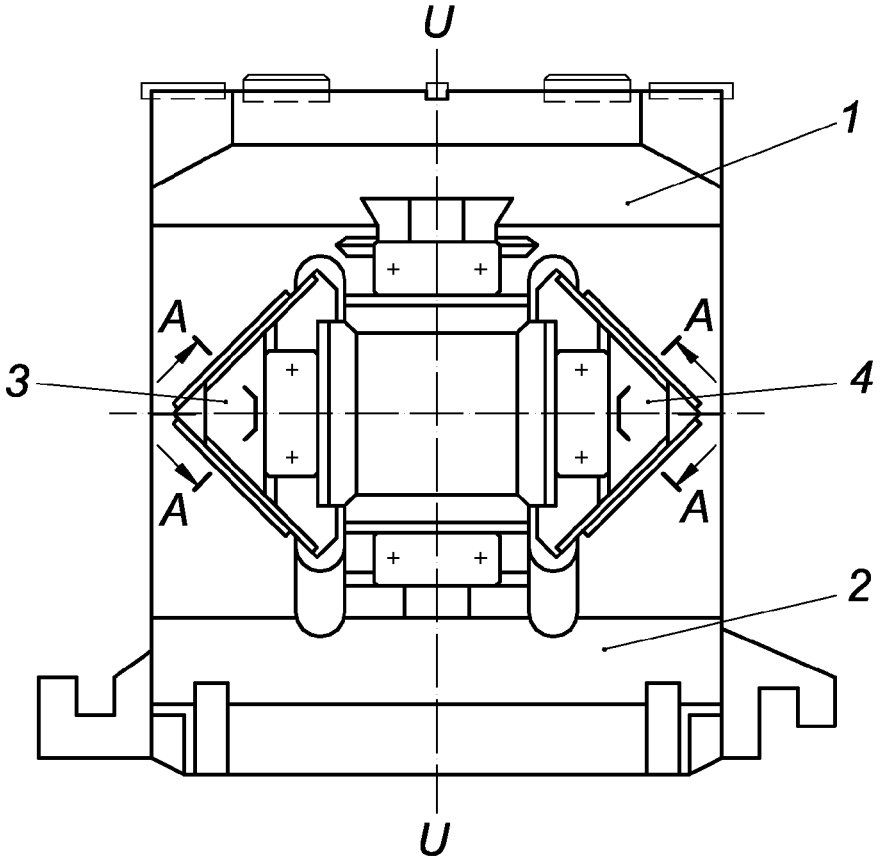
FIG. 13 shows the four-die forging device complete with the apart-guiding ways mounted on the die holders inclined planes (front view)
Figure 14:
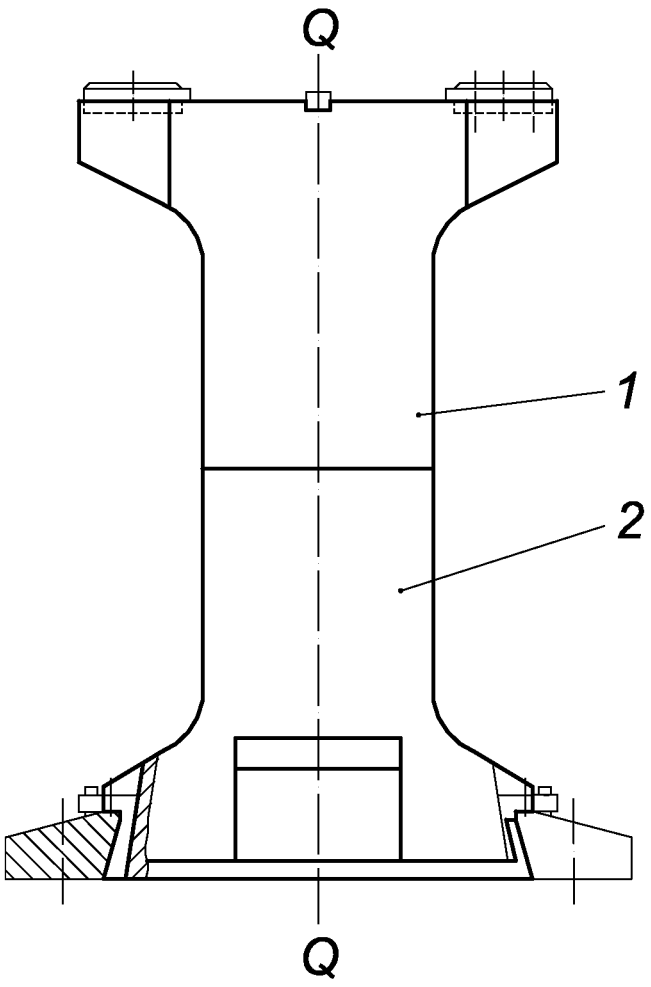
FIG. 14 shows the four-die forging device complete with the apart-guiding ways mounted on the die holders inclined planes (side view)

Internal planes of the apart-guiding ways 9-16 mounted on the side surfaces of the die holders, as well as the planes of the die holders—or the planes of the parts rigidly secured to said die holders—enclosed by said internal planes to build a clutch-type connection (with the possibility of relative movement), are oriented—each of them—at an angle of $\alpha$=0-170° to the plane in which the apart-guiding is fastened to the die holder (FIGS. 9-11).

This allows smooth and misalignment-free movement of the side die holders relative to the top- and bottom die holders. However, at the angles of $\alpha$>170° misalignment and jamming of the side die holders resulting in damage to the apart-guiding ways are likely to occur.

Figure 15:
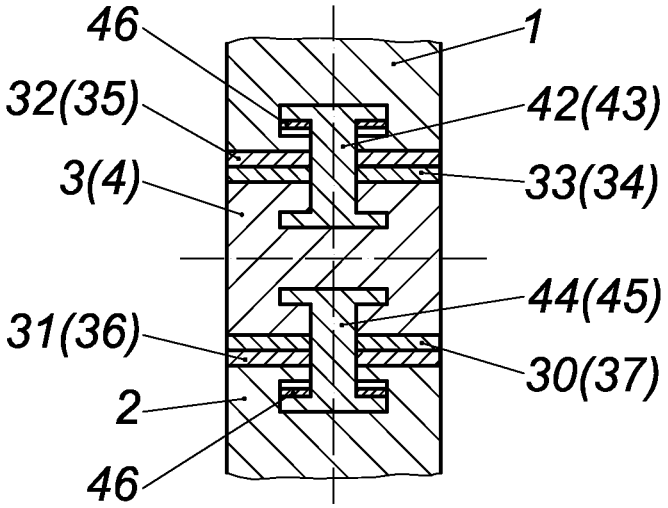
FIG. 15 shows section A-A (version I) as per FIG. 13.

The apart-guiding ways 42-45 can be also formed as H-beams (FIGS. 13-21). They are installed on the die holders' inclined planes in the device longitudinal symmetry plane Q-Q. There exist a number of versions of installation of the apart-guiding ways 42-45 formed as H-beams on the die holders' inclined planes in the device longitudinal symmetry plane Q-Q (FIGS. 13-21). The first known version is that all the four apart-guiding ways 42-45 are stationary fixed on the holders 3, 4, while internal plane of each apart-guiding way is movably contacting the respective enclosed internal plane of the holders 1, 2 (FIG. 15). Such design provides for reliable fastening of the apart-guiding ways and for their long-term failure-free service. However, in some cases this version of the apart-guiding ways fastening is not applicable due to the fact that the fastening grooves in the side die holders and the grooves in the top- and bottom die holders are rather difficult to manufacture.

Figure 16:
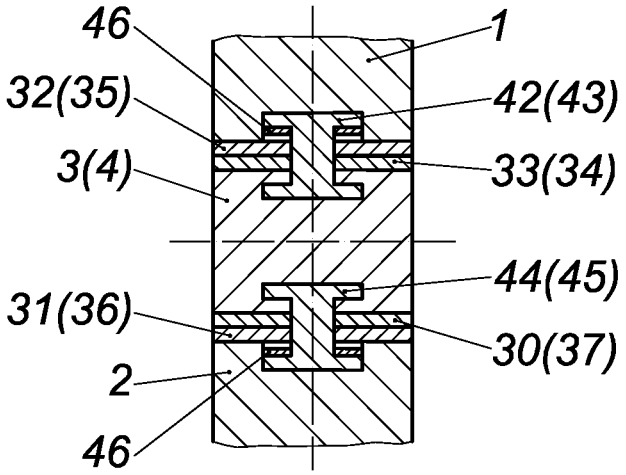
FIG. 16 shows section A-A (version II) as per FIG. 13.

Therefore another version for the apart-guiding ways installation can be used consisting in that all the four apart-guiding ways 42-45 are stationary fixed on the holders 3, 4 of the side dies, while internal plane of each apart-guiding way movably contacts the respective enclosed plane of antifriction plate 32 (35) and 31 (36) rigidly fastened on the holder 1 of the top die and on the holder 2 of the bottom die (FIG. 16). This version is easier in manufacture since it does not involve manufacture of complicated T-grooves in the side die holders. At the same time it provides for a sufficiently reliable fastening of the apart-guiding ways.

Figure 17:
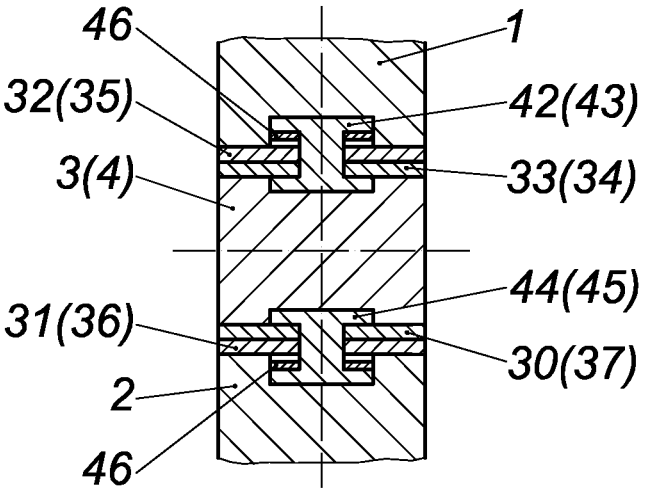
FIG. 17 shows section A-A (version III) as per FIG. 13.

Also possible is another version of the apart-guiding ways installation consisting in that all the four apart-guiding ways 42-45 are stationary fixed on holders 3, 4 of the side dies by means of antifriction plates 33 (34) and 30 (37), while internal plane of each apart-guiding way movably contacts respective enclosed plane of antifriction plate 32 (35) and 31 (36) rigidly fastened on the holder 1 of the top die and holder 2 of the bottom die (FIG. 17). This version is significantly easier since it does not involve manufacture of complicated T-grooves in the side die holders 3, 4 and in the holders 1, 2 of the top- and bottom dies.

There is yet another possible version of the apart-guiding ways installation consisting in that all the four apart-guiding ways 42-45 are stationary fixed on the holder 1 of the top die and the holder 2 of the bottom die, while internal plane of each guiding way movably contacts respective enclosed internal plane of holder 3 of the side die and holder 4 of the side die (not shown). Said version provides for reliable fastening of the apart-guiding ways and their long failure-free operation. However this version of the guiding ways installation is not applicable for all the cases, since it involves manufacture of complicated T-grooves in all the die holders.

Figure 18:
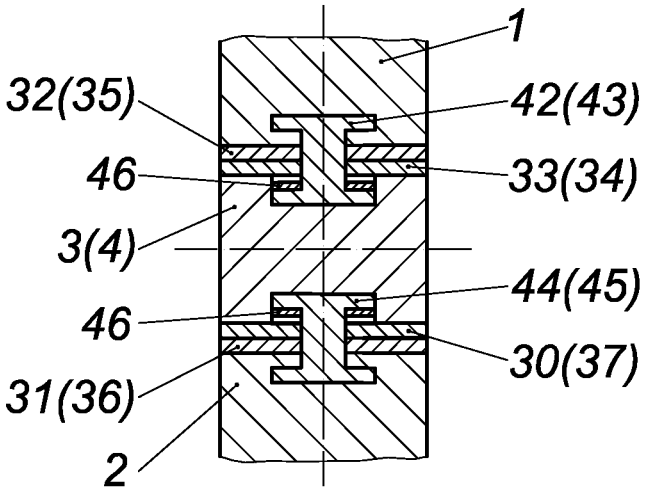
FIG. 18 shows section A-A (version IV) as per FIG. 13.

There is yet another possible version of the apart-guiding ways installation consisting in that all the four apart-guiding ways 42-45 are stationary fixed on the holder 1 of the top die and the holder 2 of the bottom die, while internal plane of each guiding way movably contacts respective enclosed internal plane of the antifriction plate rigidly fastened to holders 3, 4 of the side dies (FIG. 18). This version is easier as compared to the previous one, since it does not involve manufacture of complicated T-grooves in holders 3, 4 of the side dies. At the same time, it provides for reliable fastening of the guiding ways.

Figure 19:
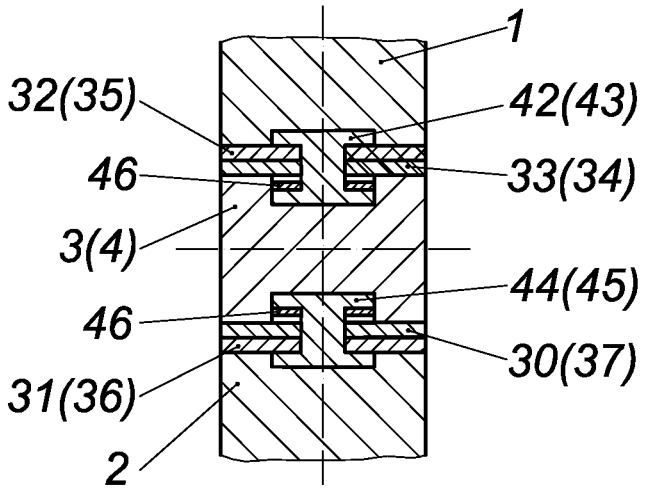
FIG. 19 shows section A-A (version V) as per FIG. 13.

There is yet another possible version of the apart-guiding ways installation consisting in that all the four apart-guiding ways 42-45 are stationary fixed on the holder 1 of the top die with the help of antifriction plates 32 (35) and on the holder 2 of the bottom die with the help of antifriction plates 31 (36), while internal plane of each guiding way movably contacts respective enclosed internal plane of antifriction plates 33 (34) and 30 (37) rigidly fastened to holders 3, 4 of the side dies (FIG. 19). This version is significantly easier as compared to that illustrated in FIG. 18, since it dies not involve manufacture of complicated T-grooves in the top- and bottom die holders.

Figure 20:
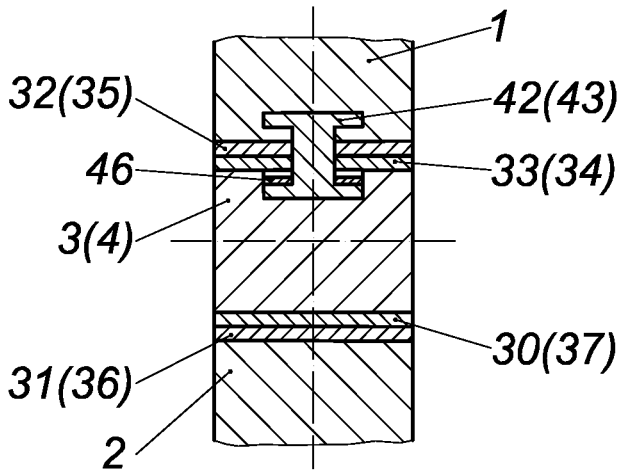
FIG. 20 shows section A-A (version VI) as per FIG. 13.
Figure 21:
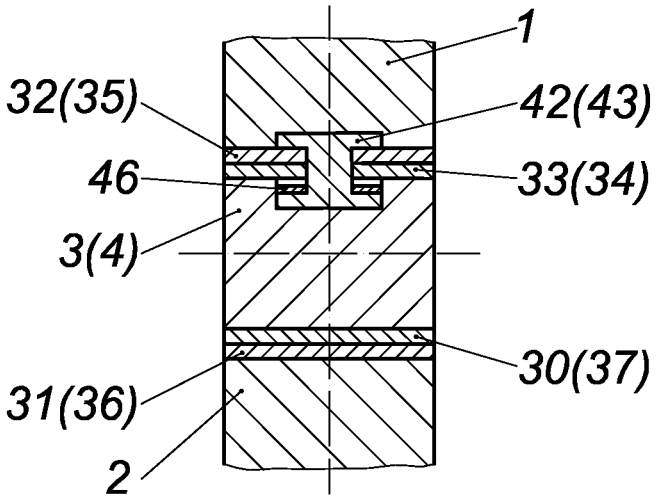
FIG. 21 shows section A-A (version VII) as per FIG. 13.
Figure 23:
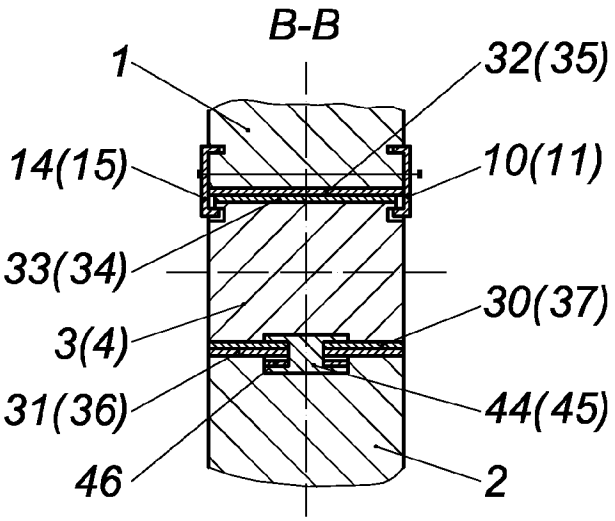
FIG. 23 shows section B-B as per FIG. 22.

There are yet other possible versions of installation of two H-shaped apart-guiding ways which provide for normal operation of the forging device (FIGS. 20, 21). These versions consist in the following: with the top die holder 1 moving upwards, holders 3, 4 of the side die move downwards under gravity and thus the dies of the forging device are moved apart.

There is yet another possible version of installation of two H-shaped apart-guiding ways consisting in that both apart-guiding ways 42 (43) are stationary fixed on holder 1 of the top die, while internal plane of each apart-guiding way movably contacts respective enclosed internal plane of the holder 3 and the holder 4 of the side die (not shown). This version provides for high reliability of the apart-guiding ways operation. However, it is not applicable for all the cases, since it involves manufacture of complicated T-grooves in all the die holders.

Also possible is a version of two apart-guiding ways installation consisting in that the apart guiding ways 42 (43) are stationary fixed on holder 1 of the top die, while internal plane of each apart-guiding ways movably contacts respective enclosed antifriction plate 33 (34) rigidly fastened on the holders 3, 4 of the side dies (FIG. 20). This version is easier in manufacture as compared to the previous one, since it does not involve manufacture of complicated T-grooves in holders 3, 4 of the side dies. At the same time, it provides for reliable fastening of the apart-guiding ways.

There is yet another possible version of two apart-guiding ways 42 (43) installation consisting in that said guiding ways are stationary fixed on the holders 3, 4 of the side dies, while internal plane of each apart-guiding way movably contacts respective enclosed antifriction plate 32 (35) rigidly fastened on the holder 1 of the top die (not shown). This version also provides for reliable fastening of the apart-guiding ways; however, it is not applicable for all cases because of necessity to manufacture complicated T-grooves in the side die holders.

Also possible is a version of two apart-guiding ways 42 (43) installation consisting in that these apart-guiding ways are stationary fixed on the holder 1 of the top die with the help of antifriction plates 32 (35), while internal plane of each guiding way 42 (43) movably contacts the respective enclosed antifriction plate 33 (34) rigidly fastened on the holder 3, 4 of the side die (FIG. 21). This version of the apart-guiding ways installation is notable for its simplicity.

Also possible is a version of two apart-guiding ways 42 (43) installation consisting in that said apart-guiding ways are stationary fixed on the holders 3, 4 of the side dies with the help of antifriction plates 33 (34), while internal plane of each apart-guiding way 42 (43) movably contacts the respective enclosed antifriction plate 32 (35) rigidly fastened on the holder 1 of the top die (not shown). This version of the apart-guiding ways installation is also notable for its simplicity, since it does not involve manufacture of complicated T-grooves in the die holders.

Figure 22:
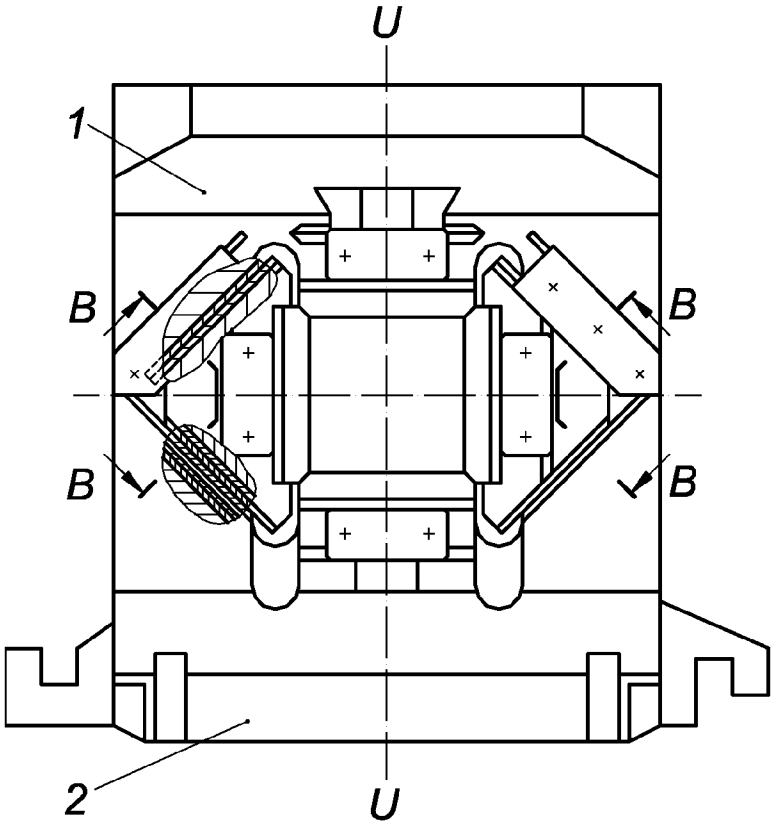
FIG. 22 shows the four-die forging device complete with the apart-guiding ways mounted on the side surfaces of the top die holder or of the side die holders and on the inclined planes of the die holders (front view)
Figure 25:
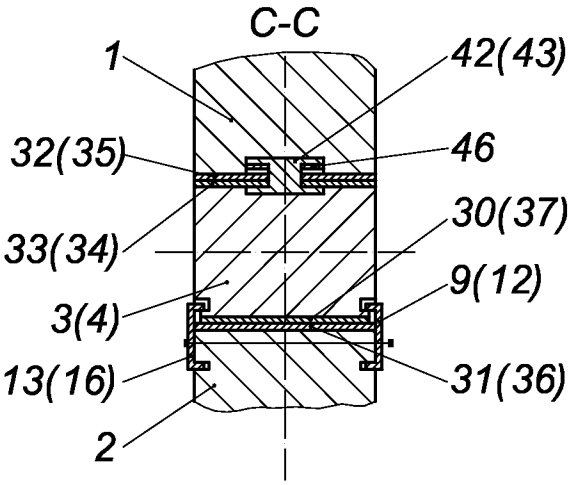
FIG. 25 shows section C-C as per FIG. 24.

Also possible is a version of six apart-guiding ways 10, 11, 14, 15, 44, 45 installation, consisting in that fastened to side surfaces of the top die holder 1 (or the side die holders 3, 4) are the apart-guiding ways 10, 11, 14, 15, while the apart-guiding ways 44,45 are fastened to the inclined surfaces of the bottom die holder 2 (or the side die holders 3, 4) in the device longitudinal symmetry plane Q-Q (FIG. 22, 23). This version can be applicable in the cases when it appears to be easier in manufacture as compared to other possible versions and when the apart-guiding ways do not interfere with other components being installed on the device.

Figure 24:
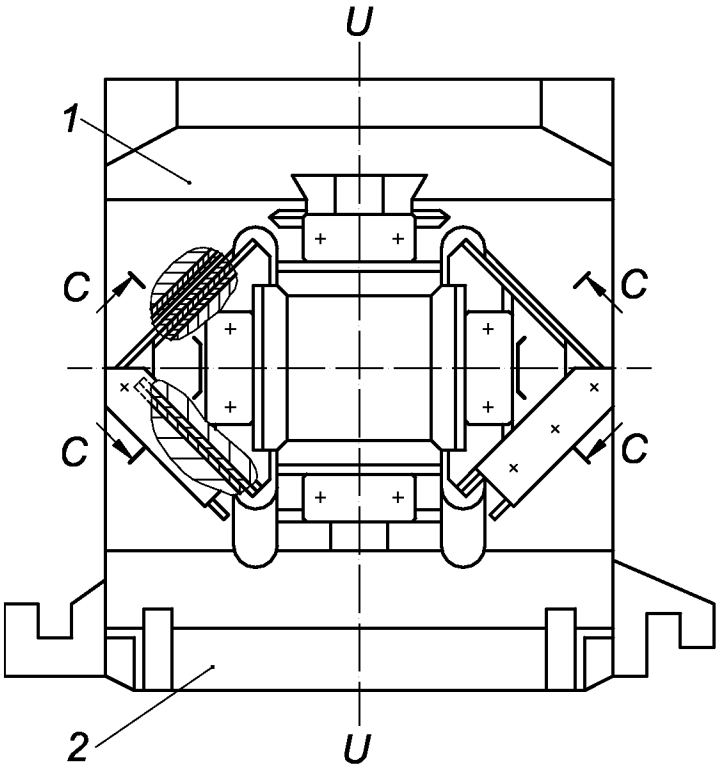
FIG. 24 shows the four-die forging device complete with apart-guiding ways mounted on side surfaces of the bottom die holder or of the side die holders and on the inclined planes of the die holders.

Also possible is a version of six apart-guiding ways 9, 12, 13, 16, 42, 43 installation consisting in that fastened to side surfaces of the bottom die holder 2 (or the side die holders 3, 4) are the apart-guiding ways 9, 12, 13, 16, while the apart-guiding ways 42, 43 are fastened to the inclined planes of the top die holder 1 (or the side die holders 3, 4) (FIG. 24, 25). This version is useful in the cases when because of some design- or manufacturing process requirements it is necessary that the side surfaces of the top die holder or side die holders are free from any components fastened thereto.

Thus in the claimed four-die forging device for forging presses a plurality of versions for the apart-guiding ways installation are possible, said apart-guiding ways being of different design, and minimum quantity of the apart-guiding ways used should be from two to six depending upon particular installation version. Foregoing versions of the apart-guiding ways installation which are not the only ones possible provide for their reliable fastening, long failure-free service life and in some cases also for simplicity of manufacture.

Internal planes of the apart-guiding ways 9-16, 42-45 serving to ensure movable contact in the clutch-type connection can be provided with antifriction coating 46 (FIGS. 6-11, 15-21, 23, 25). Said coating allows to significantly reduce friction between contacting planes, to prevent score building on these planes and to increase between-repair service life of the apart-guiding ways. Used as antifriction coating can be bronze material, for example, of "БрАЖМц" 10-3-1.5 grade.

Figure 26:
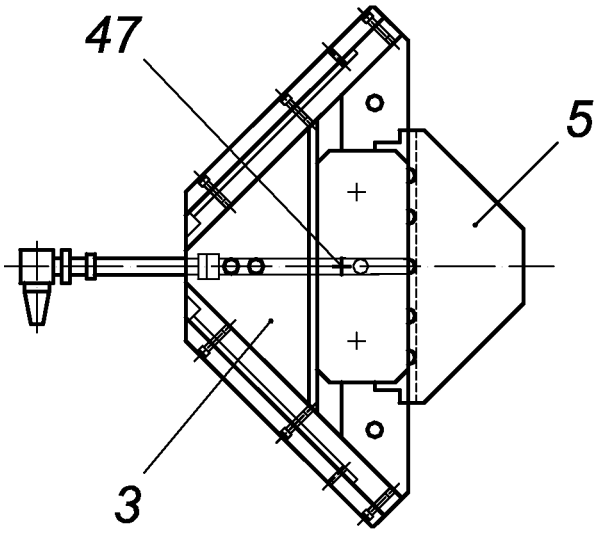
FIG. 26 shows center of mass of the side die holder completely assembled with the side die.
Figure 27:
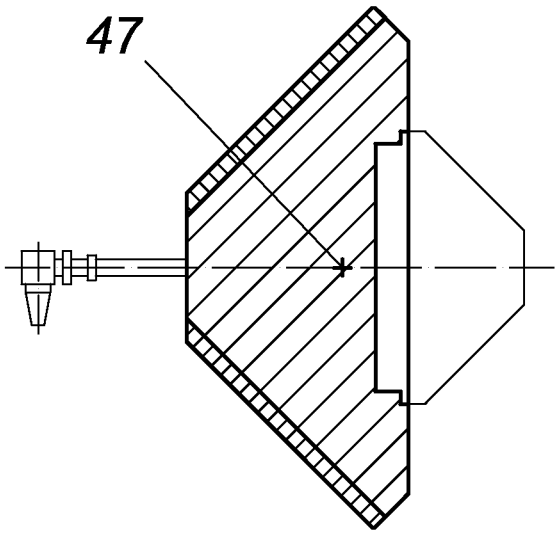
FIG. 27 shows longitudinal section of the side die holder.

The holders 3, 4 of the side dies 5, 7 in a four-die forging device have in their longitudinal section a shape which approximates that of a truncated pyramid (FIGS. 1, 26, 27), while the center of mass 47 of each "side die holder-side die" system lies within the longitudinal section of the side die 5 holder 3 (FIGS. 26, 27). It allows to provide for smooth and misalignment-free movement of the "side die holder-side die" system when the holders 3, 4 of the side dies 5, 7 perform their reciprocating motion (FIG. 1). Smooth and misalignment-free motion of the holders 3, 4 of the side dies 5, 7 allows to obtain uniform distribution of antifriction plates 30-37 or 40, 41 wearing-out over their total surface area, and also uniform distribution of the apart-guiding ways 5, 7 sliding surfaces wearing-out. Thus a longer service life of the antifriction plates and the apart-guiding ways is obtained which, in its turn, results in a longer between-repair service life of rapid-wearing parts of the forging device. If, however, the center of mass 47 of the "side die holder-side die" system comes outside the longitudinal section of side die holder, all the movable system "side die holder-side die" under certain open positions of the forging device tends to fall down thus applying excessive pressure to some certain zones of antifriction plates and the apart-guiding ways. It results in an increased non-uniformity of the antifriction plates and the apart-guiding ways wearing-out, and also in a shorter between-repair service life of these components.

Figure 28:
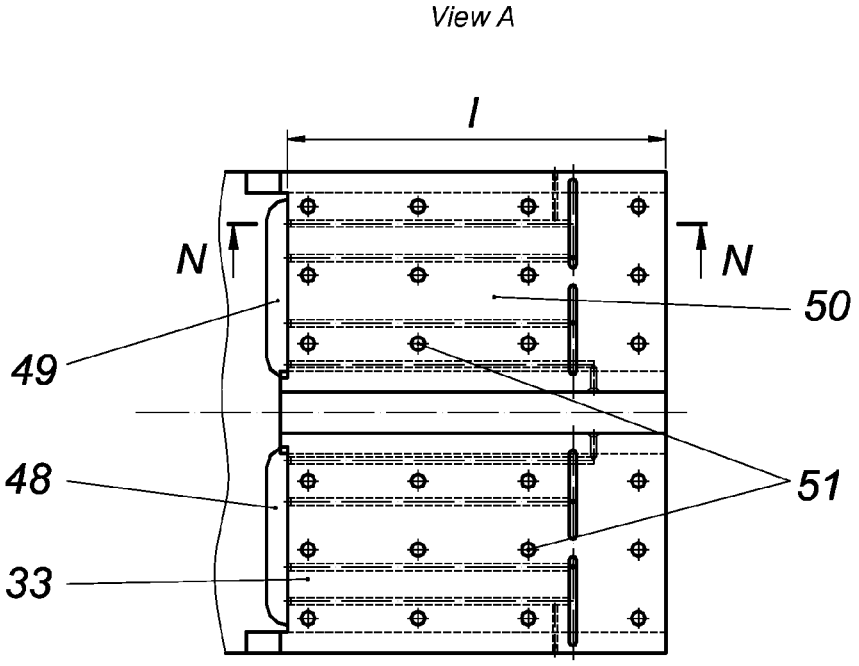
FIG. 28 shows view A as per FIG. 5.

Provided in the bottom part of inclined plane 22-25 of each side die holder 3, 4 are the ledges 48, 49 whereagainst the antifriction plates 30-37, 40, 41, 50 thrust (FIGS. 1, 5-8, 28). Said ledges provide for reliable fixing of antifriction plates. If not for these ledges, fastening screws 51 serving to hold the antifriction plates 33, 50 on the inclined plates of side die holders 3, 4 could be sheared-off, resulting in the antifriction plates creeping down said inclined planes and thus getting damaged (FIG. 28).

Figure 29:
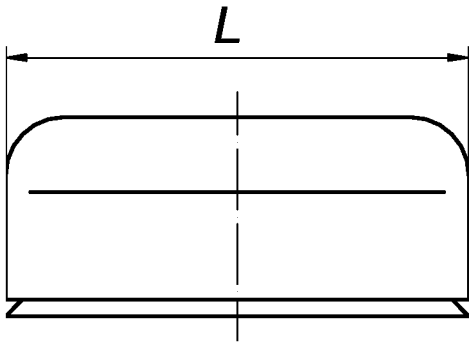
FIG. 29 shows a die front view.
Figure 30:
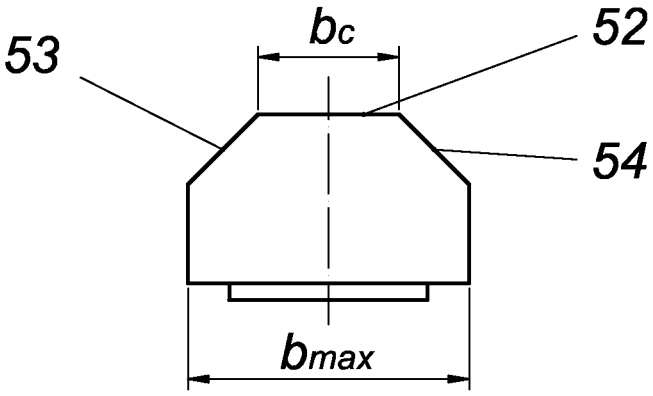
FIG. 30 shows a die side view.

Working surface of each die at its cross-section consists of a central working zone 52 and two side zones 53, 54 (FIG. 29, 30) with the maximum width of said die working surface ($b_{max}$) and the antifriction plate sliding surface length (l) being in a ratio of $$b_{max}/l \leq 1.5.$$

Under such a ratio, the device service life before repair is increased significantly due to the fact that unit pressures applied to the antifriction plates surfaces lie within tolerable values.

Under a ratio of $b_{max}$>1.5, however, the unit pressures applied to the antifriction plates surfaces can exceed tolerable values resulting in score building on said surfaces which means a significant reduction of between-repair service life of the device.

In the die structure the ratio between the die central working zone ($b_c$) and die length (L) can be as follows:

$$b_c/L=0.2-1.1.$$

Such a ratio provides for the maximum efficiency of the forging process in the claimed device and at the same time for high quality of forged products.

Under a ratio of $0.2>b_c/L>1.1$ the forging process efficiency is reduced significantly, since neither required penetration nor required reduction can be obtained under such relationship between die dimensions.

The bottom die holder 2 can have a T-shaped cross-section with its wide portion 55 located at its bearing surface side (FIG. 2, 4). This provision has been made to facilitate the device servicing and its maintenance during repair. Said design provides for better stability of the forging device under operation conditions and it also it allows to reliably and rigidly secure the device by its wide bearing surface 55 to the bottom plate of the press (not shown) with the help of grooves 17, 18, for example, of dovetail type.

The top die holder 1 can also have a T-shaped cross-section with its wide portion 56 located at its bearing surface side (FIG. 2, 4). It allows the load to be uniformly applied to the forging device when the pressure is exerted thereto from the top movable cross-beam of the press (not shown); besides, it allows to reliably and rigidly secure the device by its wide bearing surface 56 to the top movable cross-beam of the press with the help of, for example, suitable grooves and clamps 19, 20.

The four-die forging device can be additionally equipped with at least two centering guiding columns 57 mounted in the bottom die holder 2 symmetrical with respect to the vertical U-U and longitudinal Q-Q symmetry planes of the device and with a possibility of vertical movement in said guiding columns 57 of the top die holder 1 which is made spring-loaded with respect to the bottom die holder 2 (FIG. 31).

Pairs of the apart-guiding ways 9-16 arranged on the side surfaces of the die holders 1-4 symmetrically with respect to the longitudinal symmetry plane Q-Q of the device can be secured in pairs to the side surfaces of the top die holder 1 and the bottom die holder 2 with the help of pins, studs or bolts 58 penetrating through said die holders parallel to the device vertical symmetry plane U-U (FIGS. 2, 4, 6-11).

Figure 32:
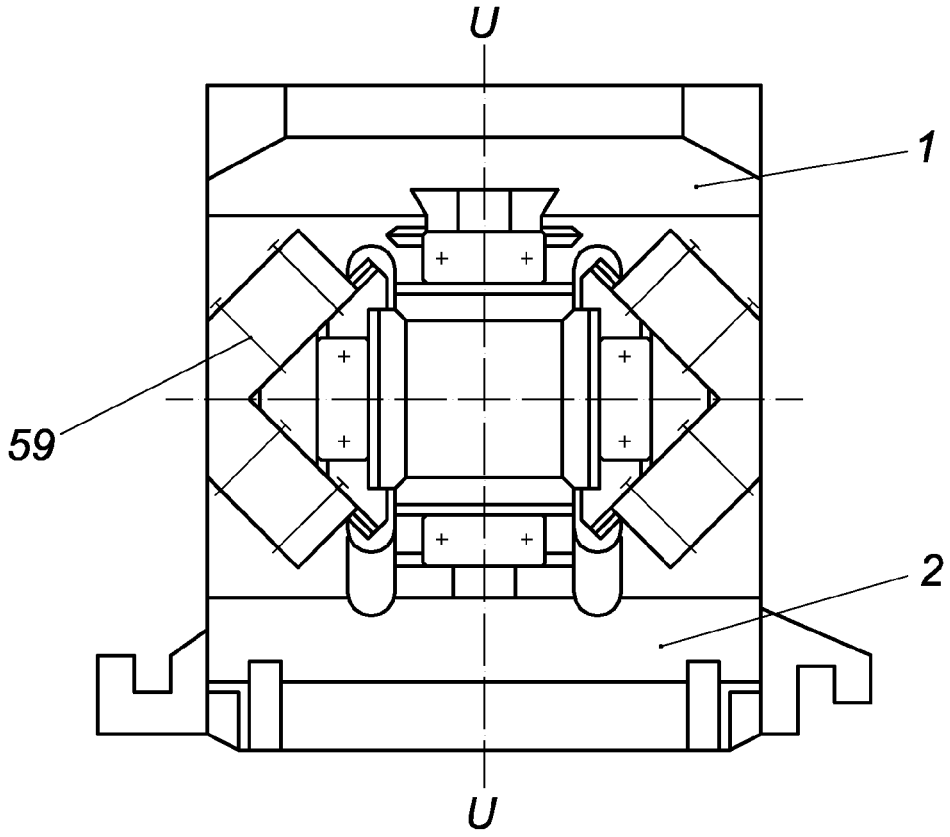
FIG. 32 shows the four-die forging device with the apart-guiding ways being secured to the die holders side surfaces with the help of pins, studs or bolts located in the plane which is perpendicular to the device vertical symmetry plane.

The apart-guiding ways 9-16 arranged on the side surfaces of the die holders 1-4 can be secured with the help of pins, studs or bolts 59 arranged in the plane perpendicular to the device vertical symmetry plane U-U (FIG. 32). Foregoing way of the apart-guiding ways 9-16 fastening in some cases may appear easier as compared to the fastening of the apart-guiding ways shown in FIG. 2.

The dies 5-8 of the four-die forging device can be fixed on the respective holders 1-4 with the help of pins, studs or bolts 60 penetrating through said holders parallel to the device vertical symmetry plane U-U and with the help of clamps 61 (FIG. 1, 33). Thus reliability of dies 1-4 fastening is ensured even when they are heated up to high temperatures during forging operation.

The four-die forging device can be equipped with a system designed to supply lubricant to friction surfaces, wherein central ducts 62 serving to feed lubricant to the device run through the side die holders 3, 4 parallel to the sliding planes of the antifriction plates 30-37 (FIGS. 1, 5, 28, 34). Thus efficient lubrication of the device friction surfaces is obtained.

Figure 33:
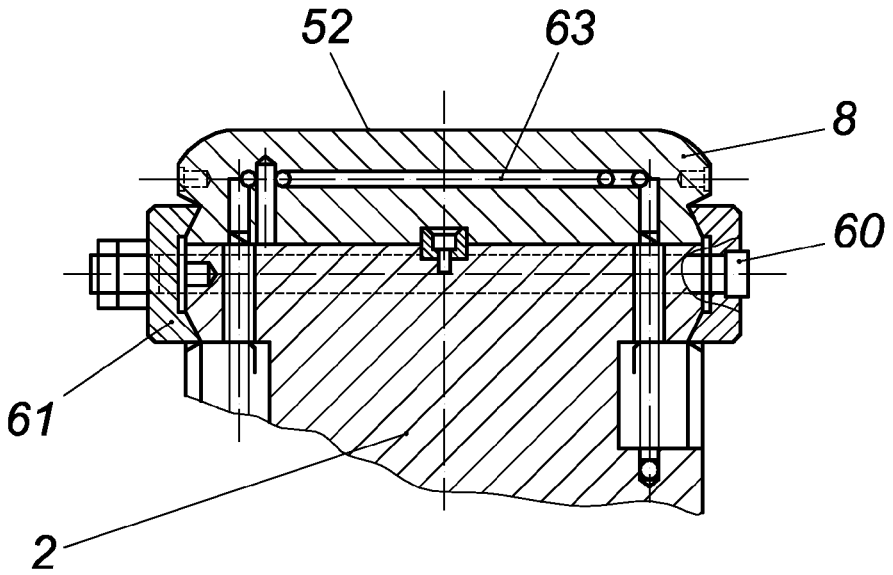
FIG. 33 shows section E-E as per FIG. 1.
Figure 34:
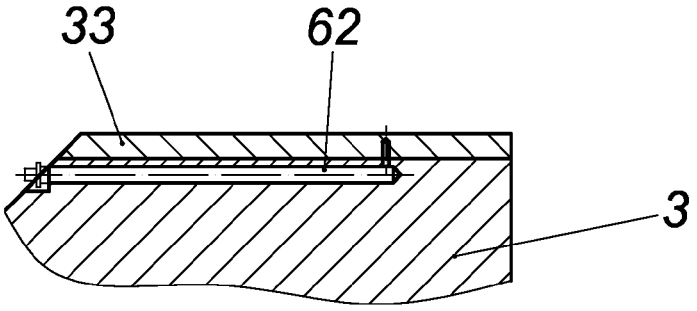
FIG. 34 shows section N-N as per FIG. 28.

The four-die forging device can be equipped with a die-cooling system comprising respective hoses (not shown) and ducts 63 arranged in the die holders 1-4 and in the dies 5-8; provided in each die body right under the central working zone 52 thereof is at least one duct 63 running parallel to the die surface (FIGS. 1, 33). This design allows to achieve intensive heat removal from the die working surface resulting in a longer before-repair service life thereof.

The antifriction plates 31, 32, 35, 36 mounted on the holders 1, 2 of the top- and the bottom dies can be made of bronze, and the antifriction plates 30, 33, 34, 37 mounted on the side die holders 3, 4 can be made of steel. Used as bronze material can be, for example, bronze grade " БрАЖМц " 10-3-1.5; used as a steel can be, for example, steel grade X12M.

Alternatively, the antifriction plates 30-37 or 40, 41 can be made of composite material containing high-temperature polyamide and long-fiber carbon with addition of graphite filler, which is normally used in self-lubricating slider bearing production (FIGS. 1, 6-8). Used as such material can be, for example, composite material WearComp200. Introduction of such material provides for a low friction coefficient (0.18-0.25), high compression resistance (520 MPA) and low wear resistance under temperatures up to 320° C. In this case no lubricant supply to the friction surfaces is required.

Figure 35:
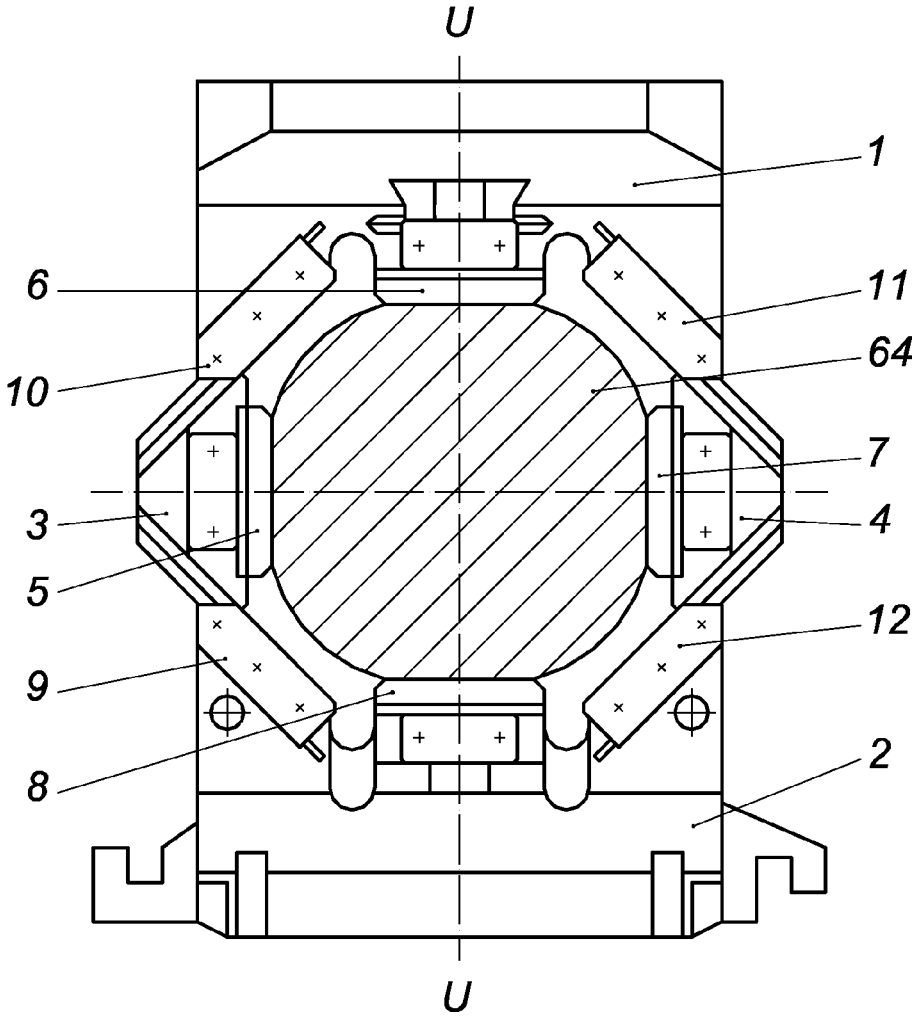
FIG. 35 shows the four-die forging device dynamic general view (in the process of swaging a component).

The four-die forging device operates as follows: The four-die forging device shall be fitted into the working space of a forging press so that the holder 2 of the bottom die 8 is rigidly secured on the bottom plate of the press (not shown) (FIG. 35). The holder 1 of the top die 6 can also be rigidly secured to the top plate mounted on the press movable cross-beam. In some cases, when there are respective springs provided in the forging device to lift it, the holder 1 is not required to be fixed to the top plate of the press (FIG. 31). Prior to feeding a billet into the forging device, it shall be opened to required extent by means of the top die holder 1 being moved upwards with the help of the press movable cross-beam (alternatively with the help of springs). With the holder 1 moving upwards, the top die 6 is moved respectively upwards, too; simultaneously the holder 1 by means of apart-guiding ways 9-16 moves the holders 3, 4 together with respective side dies 5, 7 apart, thus opening the working space of the device (FIG. 35). After the dies have been thus brought apart, a billet is fed into the working space with the help of a manipulator. Thereafter the press working stroke is started and thus the press movable cross-beam is actuated to move the holder 1 together with the top die 6 downward in the direction towards the billet 64. The top die holder 1 via its inclined planes acts upon inclined planes of the side die holders 3, 4 resulting in that the latter move together with their respective side dies 5, 7 in radial directions and towards the bottom die 8, so that they begin to simultaneously swage the billet 64 (FIG. 35). Upon completion of such swaging cycle, the movable press cross-beam together with the holder 1 and the top die 6 moves upwards. At the same time the apart-guiding ways 9-16 guide the holders 3, 4 together with their respective side dies 5, 7 upwards and apart, thus opening the working space of the forging device so that the billet can be further fed lengthwise and/or rotated around its axis. Then the next swaging cycle is performed.

Function of the four-die forging device comprising the apart-guiding ways arranged on the inclined planes of the die holders is similar to that of the four-die forging device comprising the apart-guiding ways arranged on the side surfaces of the die holders.

The claimed design of the four-die forging device allows to gain the following results:

- a significantly longer before-repair service life of the device;
- higher reliability of the device operation due to reduced risk of an abrupt failure;
- significantly higher forging output.

Industrial trials of two forging devices one of which has been built according to the present invention, while the other one—according to the prior-art embodiment, proved significant advantages of the claimed design. Used in the four-die forging device according to the present invention were four apart-guiding ways arranged on the side surfaces of top die holder, and two apart-guiding ways of H-shape arranged on the inclined planes of the bottom die holder. Provided in the bottom part of inclined plane of each side die holder were adequate ledges, against which ledges the antifriction plates made of X12M steel thrust. Arranged on the inclined planes of the top- and bottom die holders were antifriction plates made of " БрАЖМц " 10-3-1.5 bronze material. The side die holders had a longitudinal section shape approximating to that of a truncated pyramid with the centre of mass of the "side die holder-side die" system located within the limits of a side die holder longitudinal section. Internal planes of all the apart-guiding ways which served to ensure a movable contact in the clutch-type connection were provided with antifriction coating made of " БрАЖМц " 10-3-1.5 bronze material.

Besides, the following dimensions ratio was maintained:

$$b_{max}/l=0.9$$

and $$b_c/L=0.7,$$

where $b_{max}$ is the maximum width of the die working surface;

l is the length of antifriction plate sliding surface;

$b_c$ is the width of the die central working zone;

L is the die length.

Provided in the claimed device was also a system designed to supply lubricant to friction surfaces.

Ingots of structural steels in weights from 5 to 7 ton were forged in said four-die forging devices installed in a 20MN press were.

In the prior-art device, 31800 tons of forged parts were produced before the first repair thereof (breakage of an antifriction plate and one of the apart-guiding ways). Besides, it appeared necessary to replace all the other apart-guiding ways and antifriction plates because of their increased wearing-out.

In the four-die forging device according to the present invention, 75900 tons of forged parts of structural steels in diameters from 240 to 400 mm were produced. Forging tolerances were within the range of ±1 mm. The surface quality of the forged parts were approximating to that of rolled parts. There occurred no breakage of neither antifriction plates, nor apart-guiding ways. Consequently, amount of forged parts produced in the claimed embodiment device appeared to be 2.4 times higher as compared to that produced in the prior-art device.

Moreover, due to the optimized die dimensions ratio, unit-per-hour forging output of the claimed embodiment device was 1.3 times higher as compared to the unit-per-hour output of the prior-art device.

Thus, the claimed design of the four-die forging device for forging presses provides for a longer repair-free service life of the device, a higher reliability of the device in operation and a significantly increased forging process output while producing forged parts of higher quality of accuracy.

The invention claimed is:

1. Four-die forging device for forging presses comprising top- and bottom die holders (1, 2) having inclined planes (26-29), operationally interconnected thereto side die holders (3, 4) having inclined planes (22-25) which correspond to respective inclined planes (26-29) of the top- and bottom die holders (1, 2) and being arranged so that they are movable relative to top- and bottom die holders (1, 2) while being interconnected thereto by means of apart-guiding ways (9-16), antifriction plates (30-37) arranged on the inclined planes (22-29) of the top-, bottom- and each side die holders (1-4) and four dies (5-8) with working surfaces, wherein the side die holders (3, 4) have a shape approximating to that of a truncated pyramid with a centre of mass of a "side die holder (3, 4) and side die (5-7)" system located within the limits of a side die holder (3, 4) longitudinal section, the apart-guiding ways (9-16) are pairwise arranged on side surfaces of at least one of the top die holder (1), and/or bottom die holder (2) and/or side die holder (3, 4), or on the inclined planes (22-29) of at least one of the one top die holder (1), and/or bottom die holder (2) and/or side die holder (3, 4) in a longitudinal symmetry plane of the device, or on side surfaces and on the inclined planes (22-29) of at least two of the top die holder (1), and/or bottom die holder (2) and/or at least one side die holder (3, 4) in the longitudinal symmetry plane of the device, internal planes of said apart-guiding ways (9-16) being formed to enclose planes implemented in adjacent top-, and/or bottom-, and/or at least one side die holders or longitudinal planes of elements rigidly secured on said die holders (1-4) thus creating a clutch-type connection, while in the bottom part of inclined plane (22-25) of each side die holder (3, 4) respective ledges (48, 49) are provided, whereagainst antifriction plates (30-37) thrust, a working surface of each die (5-8) at its cross-section consists of a central working zone (52) and two side zones (53, 54) with a maximum width of the die working surface ($b_{max}$) and antifriction plate sliding surface length (l) being in a ratio of $b_{max}/l \leq 1.5$.

2. Device according to claim 1 wherein a width of die central working zone ($b_c$) a die length (L) are in a ratio of $b_c/L=0.2\text{-}1.1$.

3. Device according to claim 2 wherein the bottom die holder (2) has a T-shaped cross-section with a wide portion (55) located at a bearing surface side of the bottom die holder (2).

4. Device according to claim 2 wherein the top- and bottom die holders (1, 2) are of a T-shaped cross-section with a wide portion (55, 56) located at bearing surfaces sides of the top- and bottom die holders (1, 2) .

5. Device according to claim 3 wherein on the die holders (1-4) side surfaces are mounted eight said apart-guiding ways (9-16).

6. Device according to claim 1 wherein centering guideways (38, 39) are mounted on the inclined planes (26-29) of the top- and bottom die holders (1, 2) in the device longitudinal symmetry plane, and the antifriction plates (32, 33, 40, 41) of a cross-section formed as three segments, two of which are attached to the end of the third one at a right angle, said plates are mounted in twos on each one of the inclined planes (22-25) of the side die holders (3, 4), said antifriction plates forming each with one of its sides a groove of rectangular cross-section between them, which groove serves to receive the centering guideways (38, 39), while the other sides of said antifriction plates enclose side planes of the side die holders (3, 4).

7. Device according to claim 3 wherein four said apart-guiding ways (42-45) formed as H-beams are installed in T-shaped grooves on the inclined planes of the die holders in the device longitudinal symmetry plane.

8. Device according to claim 1 wherein the internal planes of the apart-guiding ways (9-16, 42-45) which serve to ensure a movable contact in the clutch-type connection are provided with antifriction coating (46).

9. Device according to claim 1 which is further provided with at least two centering guiding columns (57) mounted in the bottom die holder (2) symmetrically relative to its vertical and longitudinal symmetry planes, while the top die holder (1) is preloaded by a spring (21) relative to the bottom die holder (2) so that said top die holder (1) is movable under spring action in the guiding columns (57) relative to the bottom die holder (2).

10. Device according to claim 5 wherein said pairs of the apart-guiding ways (9-16) arranged on the side surfaces of the die holders (1-4) symmetrically relative to the device longitudinal symmetry plane are secured in twos on the side surfaces of the top- and bottom die holders (1, 2) with the help of pins, studs or bolts (58) penetrating through said die holders parallel to the device vertical symmetry plane.

11. Device according to claim 5 wherein the apart-guiding ways (9-16) are secured on the side surfaces of the die holders (1-4) with the help of pins, studs or bolts (59) arranged in a plane perpendicular to a device vertical symmetry plane.

12. Device according to claim 1 wherein the dies (5-8) are secured to the respective top-, bottom- and each side die holders (1-4) with the help of pins, studs or bolts (60) penetrating through said die holders parallel to the device vertical symmetry plane and with the help of clamps (61).

13. Device according to claim 1 which is equipped with said "side die holder (3, 4) and side die (5-7)" system designed to supply lubricant to friction surfaces with central ducts (62), which serve to supply lubricant to the device, running through the side die holders (3, 4) parallel to sliding planes of the antifriction plates (30-37).

14. Device according to claim 1 which is equipped with a die cooling system comprising hoses and ducts (63) arranged within the die holders (1-4) and dies (5-8), with each die body including at least one duct (63) located under the die central working zone parallel to a surface of the die central working zone.

15. Device according to claim 1 wherein the antifriction plates (31, 32, 35, 36) mounted on the top- and bottom die holders (1, 2) are made of bronze, and antifriction plates (30, 33, 34, 37) secured to the side die holders (3, 4) are made of steel.

16. Device according to claim 1 wherein the antifriction plates (30-37 or 40, 41) are made of composite material containing high-temperature polyamide and long-fiber carbon with addition of graphite filler normally used in self-lubricating slider bearing production.

* * * * *